US006361412B1

(12) United States Patent
Kaiser

(10) Patent No.: US 6,361,412 B1
(45) Date of Patent: Mar. 26, 2002

(54) PROCESS AND ROTARY POINT CRUSH TRUER FOR DRESSING GRINDING WHEELS WITH PROFILED WORKING SURFACES

(76) Inventor: Michael Kaiser, Am Wasserturm 33G, 29223 Celle (DE)

( * ) Notice: Subject to any disclaimer, the term of this patent is extended or adjusted under 35 U.S.C. 154(b) by 0 days.

(21) Appl. No.: 09/553,145

(22) Filed: Apr. 20, 2000

Related U.S. Application Data

(63) Continuation of application No. 09/024,505, filed on Feb. 17, 1998, now abandoned.

(51) Int. Cl.[7] ..... B24B 53/06
(52) U.S. Cl. ..... 451/56; 451/443; 125/11.03
(58) Field of Search ..... 451/56, 443; 125/11.03

(56) References Cited

U.S. PATENT DOCUMENTS

| | | | | | |
|---|---|---|---|---|---|
| 3,641,714 | A | * | 2/1972 | Asano | 51/165.87 |
| 3,898,772 | A | * | 8/1975 | Sawluk | 51/206 P |
| 4,122,635 | A | * | 10/1978 | Asano et al. | 51/165.71 |
| 4,175,537 | A | * | 11/1979 | Wiener | 125/11 CD |
| 4,862,868 | A | * | 9/1989 | Dodd et al. | 125/11 CD |
| 4,991,353 | A | * | 2/1991 | Wiener | 51/5 D |
| 5,283,983 | A | * | 2/1994 | Lazarou | 51/209 R |

* cited by examiner

*Primary Examiner*—Allen Ostrager
*Assistant Examiner*—William Hong
(74) *Attorney, Agent, or Firm*—Michael A Mann; Nexsen Pruet Jacobs & Pollard LLC

(57) ABSTRACT

The invention applies to a process and rotary point crush truer device to dress grinding wheels with profiled working surfaces with a rotary truer where the grinding wheel and rotary truer to whose surfaces are applied a material of greater hardness than the grinding wheel to be dressed, allowing the grinding wheel and rotary truer to run with the same circumferential speed and, at the same time, the grinding wheel and the rotary point crush truer device to press together under high pressure. It is the task of the invention to create a possibility of a simple means to avoid the abrasion in the above mentioned process of crush dressing with different surface speeds between the grinding wheel and the rotary truer, and thus to achieve long tool life of the dressing tool. The invention holds that a circular plane hard metal wheel is used as rotary truer to whose face diamond material is evenly applied, that the grinding wheel and rotary truer is placed in relation to each other so that between the grinding wheel and rotary truer only a near point contact occurs and that the pressing pressure between the grinding wheel and rotary truer is so high that the bond posts fracture between the single abrasive particles of the grinding wheel.

3 Claims, 2 Drawing Sheets

PROCESS AND ROTARY POINT CRUSH TRUER FOR DRESSING GRINDING WHEELS WITH PROFILED WORKING SURFACES

RELATED APPLICATION

The present application is a continuation of application Ser. No. 09/024,505, filed Feb. 17, 1998 now abandoned.

FIELD OF THE INVENTION

The invention applies to a rotary crush truer and a process for dressing grinding wheels with profiled working surfaces using a rotary truer. The surfaces of the truer carries a material of greater hardness than the grinding wheel to be dressed, allowing the grinding wheel and rotary truer to run with the same circumferential speed and, at the same time, the grinding wheel and the rotary point crush truer can press together under high pressure.

BACKGROUND OF THE INVENTION

While previously grinding wheels were dressed with the aid of diamond coated rotary truers driven at a different relative speed than the grinding wheel, and where abrasive particles were ground off from the grinding wheel to be dressed, DE 44 36 741 A1 taught the running diamond coated rotary truers at the same surface speed as the grinding wheel to be dressed so that between the grinding wheel and the rotary truer only minor slippage occurred. The diamond coated rotary truer was pressed to the grinding wheel to be dressed with such high pressure that the bond posts between the abrading particles fractured, and in this manner a destruction of the surface of the grinding wheel occurred. This process is called crush dressing. The diamond coated rotary truers showed very little wear at contact points between the grinding wheel and the rotary truer in the radial plane. The diamond coating extended over both sides and over the circumferential surface of the rotary truer's rounded surface. Since the pressing forces needed to destroy the bond posts on the grinding wheel to be dressed had to be very high, difficulties resulted from the continuously occurring axial side forces, and in manufacturing the diamond coated rotary truers having very thin forms for dressing fine curves of a grinding wheel cross section. The diamond coated rotary truers that required side support in the form of hard metal substrates due to their dimensions, restricted the geometries of truers that could be formed, and thus limited the invention's applicability.

These diamond coated rotary truers used for crush dressing had to be designed with large enough forms so that the diamond coating could be supported by a hard metal substrate to allow better, faster and more cost effective dressing than with diamond coated rotary truers where the dressing was performed between the grinding wheel to be dressed and the rotary truer with different relative speed, as is the case for example, in the device taught by German patent DE 38 11 784 where both sides of a hard metal wheel are diamond coated and serve as rotary truers.

Wheel type diamond tools with diamond application on one face side of a hard metal wheel or between two face sides of hard metal wheels are known in European Patent EP 0 410 481. These tools are applied to grinding of work pieces rather than dressing them.

SUMMARY OF THE INVENTION

The present invention avoids the disadvantages of the state-of-the-art. The object of the invention is to avoid the abrasion of the crush dressing with different surface speeds between the grinding wheel and the rotary truer as mentioned above, and thus to achieve long tool life, while dressing fine-form geometries not possible with current state-of-the-art.

This invention holds that a circular plane hard metal wheel is used as rotary truer to whose face diamond material is evenly applied, that the grinding wheel and rotary truer are placed in relation to each other so that between the grinding wheel and rotary truer a nearly point contact occurs and that the pressing pressure between the grinding wheel and rotary truer is so high that the bond posts fracture between the abrasive particles of the grinding wheel.

The result of point contact is that the pressing forces do not have to be as high as with a flat contact. An advantage of lower pressing forces for the thin diamond coating is that the required forces during the pressing can applied without damage to the rotary truer. Point contact is approached by designing the form of the rotary truer to specified angles corresponding to the desired geometry of the grinding wheel surface to be dressed. This dressing can automatically take place with a computer numerical control device operating simultaneously in both axial and radial planes.

The diamond coated hard metal wheels are prepared for the use in crush dressing by cutting a central hole in these wheels to obtain a diamond ring wheel that then can be clamped into a tool holder. The scrap from this process step, i.e., a circular PCD diamond wheel of less diameter, can be further used to trim cutting tools and this circular diamond wheel of less diameter can also be divided into pieces.

It is surprising that a radial layer of a diamond coating applied to the face side of a hard metal wheel is capable of transferring the high forces to a grinding wheel to be dressed that are necessary to fracture bond posts between the abrasive particles. This phenomenon is possible as a result of the near point contact and the thin diamond layer. The inventive crush dressing process is called rotary point crush dressing.

The thinner the diamond layer of the rotary truer, the better and more effectively the inventive process can be performed. Therefore, it can be achieved using rotary truers made from diamond coated wheels used for other purposes provided that, prior to the start of the dressing work, the thickness of the diamond coating of the rotary truer is reduced by electro-discharge machining.

To prevent a difference in relative rotational speeds between the grinding wheel to be dressed and the rotary truer, the rotary truer is rotated counter to the rotation of the grinding wheel.

The manufacture of a rotary truer for the performance of the inventive dressing process is obtained by using a circular hard metal wheel with diamond material evenly applied on its face and that has a central hole formed therein that can receive a mandrel.

For the performance of the inventive dressing process to be effective in dressing grinding wheels with profiled working surfaces, it is necessary to use a device consisting of a holding fixture for the grinding wheel to be dressed, a holding fixture for the rotary truer, a driver device operationally connected to the rotary grinding wheel and an infeed device that presses the rotary truer against the grinding wheel. The rotary point crush truer device is remarkable in that the rotary truer is a hard metal wheel to which polycrystalline diamond (PCD) material is evenly applied. Into the center of that material is processed a hole so that the hard metal wheel can be held by the holding fixture in a position where only a nearly point contact exists between the diamond material portion of the hard metal wheel and the grinding wheel. Furthermore, the infeed device is adapted to apply a highly accurate range of infeed pressure between the grinding wheel and rotary truer so that the bonding posts between the single abrasive particles of the grinding wheel fracture at the contact point.

The rotary point crush truer device can be made more effective when the thickness of the diamond layer of the rotary truer is reduced with electro-discharge.

The rotary point crush truer device can have an especially long life if the rotary truer rotates counter to the grinding wheel.

The rotary point crush truer device is more effective if the side of the rotary truer that is coated with diamond material has a greater diameter than the opposing side. The desired point contact between the grinding wheel to be dressed and the rotary point crush truer can always be obtained if the angle of the holding fixture of the rotary point crush truer is changeable.

It is especially advantageous if a computer numerical control device is installed that uses a numerically controlled motion program to alter the axial feed of the rotary point crush truer relative to the grinding wheel to be dressed, the setting angle, and the infeed pressure during the dressing process.

The diamond application to the hard metal wheel is preferably a polycrystalline layer. Alternatively, wheels coated with diamond mass per the CVD technique used by General Electric instead of using polycrystalline diamond wheels (PCD).

Alternatively, hard metal wheels can be coated with sections of diamond material as a rotary point crush truer.

BRIEF DESCRIPTION OF THE DRAWINGS

The essence of the invention is explained in detail as follows in the drawing with schematic examples. They show.

DETAILED DESCRIPTION OF PREFERRED EMBODIMENTS

Figure 2:
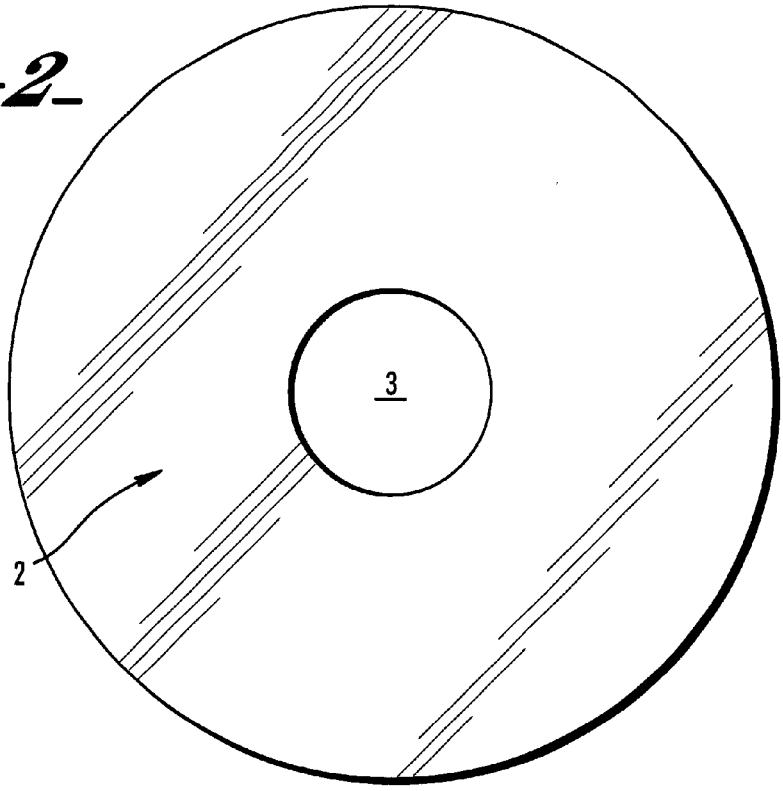
FIG. 2 The rotary point crush truer coated with diamond material (2) in face view.
Figure 1:
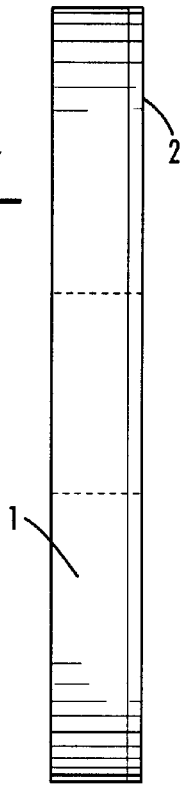
FIG. 1 The rotary point crush truer coated with diamond material (2) in side view.
Figure 3:
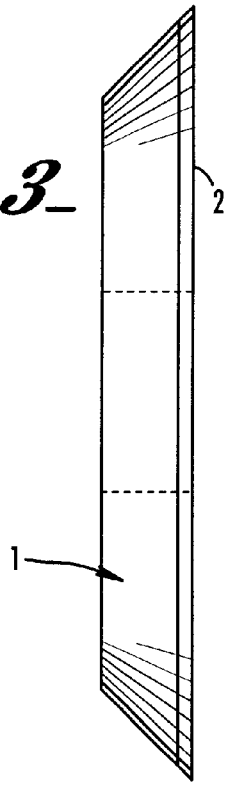
FIG. 3 Another rotary point crush truer applied with diamond material (2) with decreasing diameter in side view.

Referring now to FIGS. 1–3, the rotary point crush truer consists of a hard metal wheel 1, whose one side is coated with diamond material 2. The rotary point crush truer has a central hole 3 so that it can be clamped into a holding fixture and rotated, preferably at the same speed as the grinding wheel.

In FIG. 3, the diameter of the rotary point crush truer is shown decreasing in direction away from the face side carrying the diamond material. With such a rotary truer, grooves and similar fine-form dressing can be done on grinding wheel 4.

Figure 4:
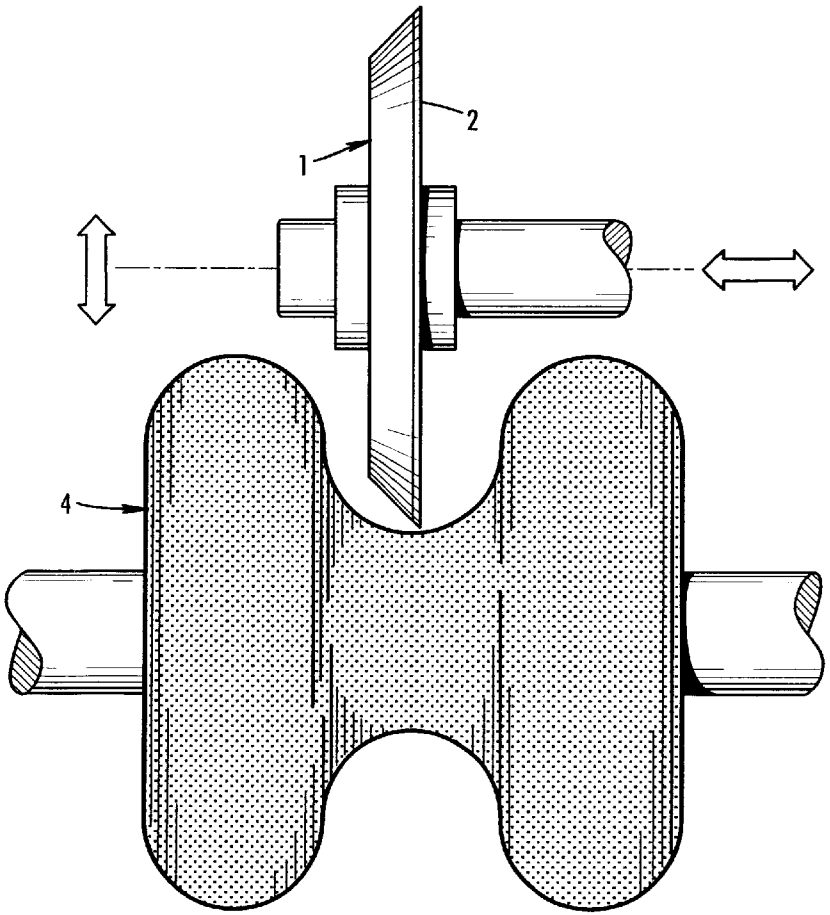
FIG. 4 The rotary point crush truer applied with diamond material in process on a profiled grinding wheel on a place where processing is done with both in parallel axis.

FIG. 4 shows that only the circumferential edge on the grinding wheel 4 turned away from the hard metal wheel is engages the grindstone 4. Arrows indicate the direction of forces applied to move the rotary point crush truer into engagement with the grindstone 4 for dressing.

Figure 5:
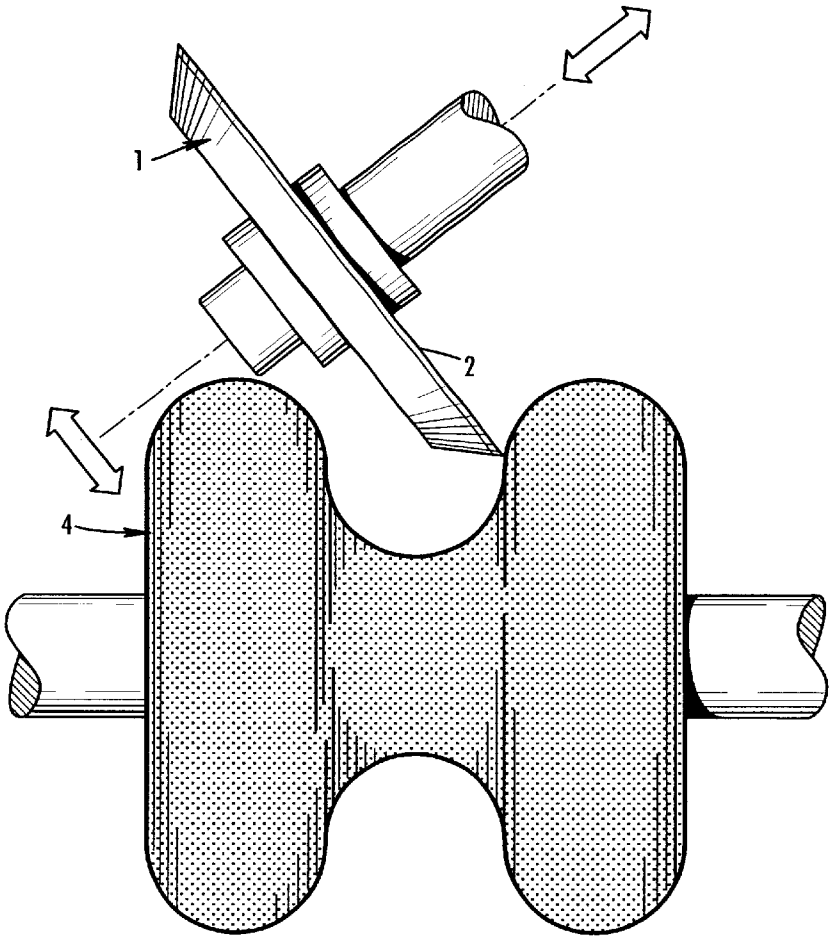
FIG. 5 The rotary point crush truer (½) applied with diamond material (2) in process on a profiled grinding wheel (4) on a place where processing is done where the contact point of the rotary point crush truer and grinding wheel (4) to be dressed face each other under an acute angle.

As seen in FIG. 5, the rotary point crush truer applied with diamond material 2 is illustrated in the process of dressing a profiled grinding wheel 4 on a place where processing is done where the contact point of the rotary point crush truer and grinding wheel 4 to be dressed face each other at an acute angle.

The PCD layer on the hard metal wheel can be applied during the manufacturing process on the hard metal wheel or applied as thin layer on the hard metal wheel per the CVD method.

When the relative speed of the diamond grinding wheel and grindstone is zero, both roll off each other, although it is very seldom exactly zero due to slippage. The great advantage of this inventive "round plate design" is the fact that the diameter of the rotary point crush truer can decrease through wear but it can still be used (e.g., for centerless straight grinding, provided that the crushing roll is adjusted radially). The computer numerical control, therefore, does not require readjustment in the axial direction corresponding to the wear of the tooling, but only radial. This leads to the possibility of using substantially simpler computer numerical controller inputs.

What is claimed is:

1. A device for dressing a grinding wheel having a profiled working surface, said device comprising:

a holding fixture for holding a grinding wheel;

a rotary truer;

a holding fixture for holding said rotary truer;

means for rotating said grinding wheel with respect to said rotary truer; and an infeed device that presses together said rotary truer and said grinding wheel; and an infeed device for pressing said rotary truer against said grinding wheel, said rotary truer being a hard metal wheel having a face that is evenly coated with polycrystalline diamond material and into which face is centrally processed a hole, said infeed de4ce being designed for highly accurate ranges of infeed feed pressure between said grinding wheel and said rotary truer, so that bond posts of single abrasive particles of said grinding wheel fracture, and said rotating means rotating said grinding wheel counter to said rotary truer at zero relative surface speed, without slippage.

2. The device as recited in claim 1, wherein said hard metal wheel is tapered so that nearly point contact occurs between said hard metal wheel and said grinding wheel to be dressed.

3. The device as recited in claim 2, wherein said hard metal wheel is reduced so that nearly point contact occurs between said hard metal wheel and said grinding wheel to be dressed.

* * * * *